United States Patent [19]

Neuroth

[11] 4,454,378

[45] * Jun. 12, 1984

[54] ARCUATE ARMORED CABLE

[75] Inventor: David H. Neuroth, Bethany, Conn.

[73] Assignee: Harvey Hubbell Incorporated, Orange, Conn.

[ * ] Notice: The portion of the term of this patent subsequent to Oct. 11, 2000 has been disclaimed.

[21] Appl. No.: 447,969

[22] Filed: Dec. 8, 1982

[51] Int. Cl.[3] ..... H01B 7/18

[52] U.S. Cl. ..... 174/103; 174/102 SP; 174/106 R; 174/109; 174/117 F

[58] Field of Search ..... 174/15 C, 102 SP, 103, 174/106 R, 108, 109, 117 F, 47

[56] References Cited

U.S. PATENT DOCUMENTS

| | | | |
|---|---|---|---|
| 1,740,076 | 12/1929 | Delon | 174/116 X |
| 2,165,738 | 7/1939 | Van Hoffen | 174/105 R |
| 2,391,037 | 12/1945 | Shafer, Jr. | 174/102 SP |
| 2,483,301 | 9/1949 | Roberds | 174/15 C |
| 2,544,233 | 3/1951 | Kennedy | 174/117 R X |
| 2,897,253 | 7/1959 | Davey et al. | 174/109 X |
| 3,351,706 | 11/1967 | Gnerre et al. | 174/105 R |
| 4,196,307 | 4/1980 | Moore et al. | 174/47 |
| 4,262,703 | 4/1981 | Moore et al. | 174/47 X |
| 4,277,642 | 7/1981 | Piper et al. | 174/117 R X |
| 4,282,398 | 8/1981 | Solomon | 174/106 R |
| 4,374,530 | 2/1983 | Walling | 174/47 X |

FOREIGN PATENT DOCUMENTS

| | | | |
|---|---|---|---|
| 1020074 | 11/1957 | Fed. Rep. of Germany | 174/117 R |
| 437525 | 10/1935 | United Kingdom . | |
| 1242494 | 8/1971 | United Kingdom . | |
| 1250823 | 10/1971 | United Kingdom | 174/136 |
| 2069746 | 8/1981 | United Kingdom . | |

*Primary Examiner*—J. V. Truhe
*Assistant Examiner*—Morris H. Nimmo
*Attorney, Agent, or Firm*—Jerry M. Presson; Alfred N. Goodman

[57] ABSTRACT

An armored cable is formed with an arcuate cross-sectional shape which substantially conforms to the curvature of the surface on which it is mounted. This shape takes maximum advantage of the annular space available, for example, between the inner wall defining the circular bore of an oil well and the cylindrical surface of a centrifugal submersible pump on which the cable is mounted. As a result, the diameter, and hence the efficiency, of the pump may be maximized.

17 Claims, 3 Drawing Figures

ARCUATE ARMORED CABLE

This invention relates to a cable for use in extreme environments and more particularly, to a flat cable for supplying electrical power to submersible oil well pumps.

BACKGROUND OF THE INVENTION

Electrical cables which are used for supplying electrical energy to submersible oil well pumps must be able to survive and perform satisfactorily under extremely adverse conditions of heat and mechanical stress. Ambient temperatures in oil wells are often high and the $I^2R$ losses in the cable itself add to the ambient heat. The service life of a cable is known to be inversely related to the temperature at which it operates. Thus, it is important to be able to remove heat from the cable while it is in these extreme operating environments.

Such cables are subjected to mechanical stresses in several ways. It is common practice to fixedly attach the cables to the housing of the electrical submersible pump or oil well tubing by means of bands or straps which may crush the cables and thereby seriously degrade the effectiveness of the insulation and strength of the cable. The cables may also be subject to impact damage during installation and high compression loads during and after installation, particularly when the cable is inserted into wells that do not have perfectly straight bores.

It is therefore conventional to provide such cables with external metal armor anad to enclose the individual conductors within layers of materials chosen to enhance strength characteristics of the cable, but such measures are sometimes not adequate to provide the necessary protection.

An additional problem arises as a result of down-hole pressures, which can be in the hundreds or thousands of pounds per square inch, to which the cables are subjected. Typically, the insulation surrounding the conductors in a cable contains micropores into which gas is forced at these high pressures over a period of time. Then, when the cable is rather quickly extracted from the wall, there is not sufficient time for the intrapore pressure to bleed off. As a result of this decompression, the insulation tends to expand outwardly like a balloon and can rupture, rendering the cable weakened or useless thereafter.

In U.S. Pat. No. 4,409,431 in which the assignee is the same as the assignee of the instant invention, there is described a cable structure which is particularly suitable for use in such extemely adverse environments. The structure protects the cable against inwardlydirected compressive forces and provides for the dissipation of heat from the cable which is an important feature in high temperature operating environments, for reasons discussed therein, as well as resistance to decompression expansion of the insulation.

As described in U.S. Pat. No. 4,409,431, the cable protective structure includes one or more elongated force-resisting members which extend parallel and adjacent an insulated conductor comprising the cable. The members are rigid in cross-section to resist compressive forces which would otherwise be borne by the cable conductors. For applications requiring the cable to undergo long-radius bends in service, the elongated support may be formed with a row of spaced-apart slots which extend perpendicularly from one edge of the member into its body to reduce the cross-sectional rigidity of the member in the slotted areas so as to provide flexibility in the support to large-radius bending about its longitudinal axis.

As described in my copending patent application Ser. No. 390,308 filed June 21, 1982 and assigned to the same assignee as the present invention, for certain service applications, it may be preferred that the electrical insulating sheath on the cable conductor not be in direct contact with the slot openings. This is because the slot openings in the support member may allow highly corrosive materials to gain access to the jacket composition by flowing inwardly through the slots. In addition, the corners formed by the slots may cut into or abrade the underlying cable jacket upon repeated bending of the cable.

The cable protective structure of said copending application Ser. No. 390,308 is made of a composite structure which utilizes an elongated force-resisting member of good thermal conductivity positioned adjacent the insulating conductor sheath. This member comprises a channel member of U-cross-sectional shape. A smooth, bendable liner may be mounted within the channel facing the insulation of the adjacent conductor to bridge the slots in the member and thereby protect the underlying insulation from abrasion by the slot edges during bending of the channel member.

The exterior jacket or armor, the liners and the channel members all serve to protect the conductor insulation, and hence the cable, from damage caused by compression forces, impacts and decompression expansion.

Supplementary resistance to compressive forces may be obtained with a cable constructed in accordance with my copending applications Ser. Nos. 429,530 and 429,781, filed on Sept. 30, 1982 and assigned to the same assignee as the instant invention.

For certain service applications and particularly suitable oil well applications, the cable must be able to be axially inserted and withdrawn through an open space formed between the interior circular wall of the well casing and the exterior surface of the oil well tubing, electric submersible pump housing or other structure to which the cable is affixed. Typically, the cable is mounted on the exterior surface of a centrifugal pump and hence, extends outwardly of the pump housing thereby posing a potential obstruction to a proper fit in the oil well casing. Furthermore, it follows that the thicker the cable in cross-section, the smaller the cross-sectional dimension that the pump must have for both to fit into an oil well casing of a given cross-sectional size. Electrically-powered centrifugal pumps, however, are typically much more efficient in larger diameters, and thus, it is preferred that the cross-sectional thickness of the associated cable be made as small as possible so that the user can employ the most efficient pump. Since these structures are typically cylindrical, the open space between them is essentially annular in cross-section, being defined by two essentially circular surfaces of different radii.

As mentioned above, for these applications, the cable is subject to very high temperatures and pressures, severe compressive forces in the well and impacts during installation from, for example, hammers or other tools. Hence, it is desirable to use the cables disclosed in my aforementioned patent applications and yet, it is also desirable to minimize the effective thickness of the cable and thus, the possibility that the cable will jam or lodge against the well casing during the insertion or withdrawal of the equipment to which the cable is affixed.

According to this invention, the armored cable is formed with an arcuate cross-sectional shape which conforms to the curvature of the surface on which it is mounted. This reduces the effective thickness of the cable by conforming to and taking maximum advantage of the annular space available between the wall of the well and the cylindrical structure therein.

OBJECTS OF THE INVENTION

An object of this invention is to provide a substantially flat electrical cable having a shape in cross-section which conforms to the circular cross-sectional shape of a bore in which the cable is used.

Another object of this invention is to provide an armored electrical cable of arcuate cross-sectional shape which is especially suitable for use in oil wells.

Yet another object of this invention is to provide an armored electrical cable structure of arcuate cross-sectional shape for oil well applications incorporating means for resisting various disruptive forces encountered in these applications.

Other objects, advantages and salient features of the present invention will become apparent from the following detailed description which, taken in conjunction with the annexed drawings, discloses a preferred embodiment of the invention.

DETAILED DESCRIPTION OF THE INVENTION

Figure 1:
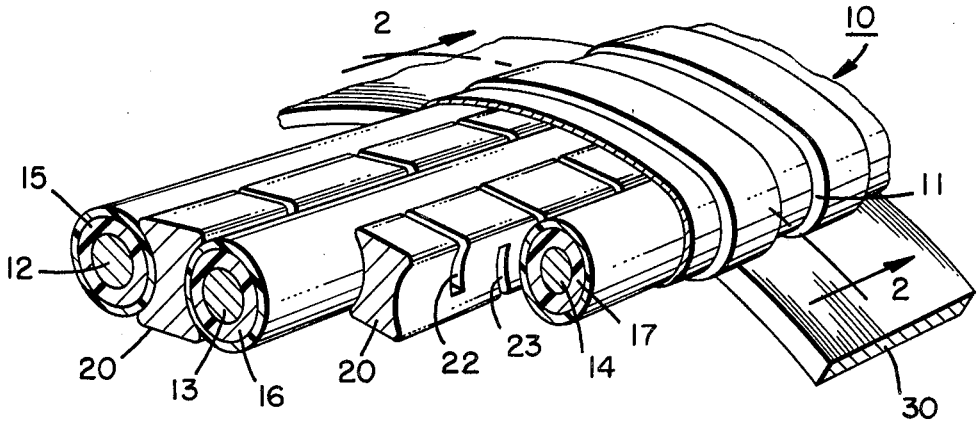
FIG. 1 is a partial perspective sectional view of a length of cable constructed in accordance with this invention and a portion of a housing or other structure of generally cylindrical shape to which the cable is typically affixed, the extremity of the cable being shown with an outer protective jacket removed.

FIG. 1 illustrates one embodiment of a cable 10 constructed in accordance with the present invention which is particularly suitable for use in oil well applications. For these applications, the cable must be able to be axially inserted and withdrawn through an open space formed between the interior circular wall of the well casing and the exterior surface of the oil well tubing, electric submersible pump housing or other structure to which the cable is affixed. Since these structures typically have arcuate surfaces and more particularly, cylindrical surfaces, the open space is essentially annular in cross-section because it is defined by two essentially concentric cylindrical surfaces of different diameters.

As mentioned above, for these applications, the cable is subject to very high temperatures and pressures, and to very severe compressive forces in the well and impacts during installation from, for example, hammers or other tools.

The cable 10 includes a metal protective jacket 11 which surrounds and encloses a plurality of individually insulated, spaced-apart wires or conductors 12, 13 and 14. To provide the cable with a slightly arcuate cross-sectional configuration required for placement in the annular space between the well casing and the structure 30 to which the cable is strapped the conductors are arranged so that their central axes lie in an arcuate plane parallel to the plane of the cylindrical surface of the structure 30 underlying the cable. In FIG. 1, only a portion of the structure 30 is depicted, it being understood that in its entirety, the structure could be the outer housing of an oil well pump or the electrical motor for driving the pump, a cylindrical oil well tubing leading from the pump to the surface, or any other structure having a substantially cylindrical surface upon which the cable is to be mounted.

The jacket 11 is typically formed of steel tape 11 of a Z-cross-sectional shape which is wrapped about the conductors 12, 13 and 14 in overlapping helical fashion to form an interlocked armored sheath. The juxtaposed conductors are of considerable length, as needed, it being understood that only a very short length of the cable is illustrated in FIG. 1. The conductors 12, 13 and 14 are each covered by one or more layers of electrical insulation; two such layers being illustrated and referred to by the numerals 15, 16 and 17, respectively.

As will be recognized, the insulation used in these conductors is more than simply one or more layers of chemical barrier and/or electrically insulative material. Normally, in an environment such as an oil well, a pump cable would include insulation which is a system of layers of insulated materials of different types to provide the desired electrical dielectric properties as well as resistance to various chemical reactions which occur with accelerated activity in these high temperature and pressure environments, and these insulation materials may be constrained with, or otherwise mechanically protected by, braids and/or tapes composed of metal or other suitable material. However, this insulation and mechanical covering system is, in itself, not part of the present invention and is conventional and accordingly, it will not be further described herein.

The insulated conductors are each spaced laterally from one another far enough to provide a lateral space therebetween which will accommodate a force-resisting member 20. Each of the members 20 are also elongated and extend parallel with the conductors. Members 20 are made of a material which is substantially rigid in cross-section and which is selected to have good thermal conductivity properties, i.e., thermal conductivity which is at least greater than the thermal conductivity of the conductor insulation. Fiber-filled carbon compositions are suitable for this purpose, and also exhibit good compression resistance. Metals such as steel or aluminum are also suitable for this purpose, as are metal-filled curable polymeric materials which may be extruded thermoplastic materials, such as are suitable for certain applications.

While the cable shown in the drawing has three conductors, it will be apparent that the cable could contain a different number and that the number of force-resisting members 20 will usually be one less than the number of conductors.

Inasmuch as the member 20 is quite rigid and resistive to compression in the direction of compressive forces applied in directions substantially perpendicular to the major plane of the cable 10, a greater degree of flexibility may be required which can permit the cable to undergo long-radius bends as necessary when installing it in a service location.

This greater flexibility is typically provided, when defined, by a plurality of longitudinally spaced-apart slots 22 extending inwardly, or downwardly, as illustrated in the figures, from the upper surface 26 of each member 20 and terminating approximately midway or more through the member 20. The slots 22 are substantially uniformly spaced-apart in the longitudinal direction of the member 20. Longitudinally spaced between slots 20 are slots 23 which extend inwardly and upwardly into the body of member 20 from the lower surface 27 thereof. Slots 23 are also substantially uniformly spaced-apart in the longitudinal direction, and lie approximately midway between the slots 22. Thus, the slots 22, 23 extend inwardly in an alternating pattern from the upper and lower surfaces 26 and 27, respectively, and permit greater flexibility in the member 20. When installed in a cable, the resulting structure would be similar in appearance to FIG. 1.

As will be recognized by those skilled in the art, the members 20 can be formed by extrusion, molding or other processes, followed by cutting, if greater flexibility is needed, to form the slots especially if the members are extruded. Each of the members 20 has upper and lower surfaces which are substantially flat so that they conform to the upper and lower, substantially parallel inner and outer side portions 24A and 24B, respectively, of the jacket 11, and the longitudinal edges of the members 20 may be semicircular to conform more slosely to the shapes of the opposing peripheral surfaces of insulation on adjacent ones of the insulated conductors. The four corners 28 of the members 20 are slightly rounded as by chamfering, so that the corners 28 do not break off when the cable is bent into a slightly arcuate cross-sectional shape. Crushing forces applied to the exterior of the cable will encounter the members 20 and damage to the cable by such forces will thereby be prevented or at least minimized.

Alternatively, the components interior of the cable jacket can take any of the forms disclosed in my aforementioned patent applications.

To form the desired, slightly arcuate shape, the cable 10 is initially made flat and subsequently drawn through forming dies of appropriate curvature which bend the armor sheathing transversely into a curvature which is substantially the same as that of the structure 30 against which the cable is to be mounted. Because the armor is made of metal, the sheathing remains in the desired curved shape upon removal from the forming dies.

The radius R of the inner arc defining the innermost surface of the side portion 24A of the armor 11 is typically made substantially equal to the radial distance from the centerline to the exterior cylindrical surface portion of the underlying supporting surface 30. The radius R′ of the outer side portion 24B is typically made equal to the radius R of the inner side portion 24A plus the radial thickness T of the cable. The dimension T is determined by the outer diameter of the insulated conductors plus the total radial thickness of the two side portions 24A and 24B. In order to allow unobstructed placement of the cable in the bore hole while attached to its underlying structure 30, the radius R′ should be less than the radius of the interior wall of the tubular oil well casing. In such case, the dimension T of the cable should be less than the radial dimension of the annular space between the underlying structure and the interior wall of the well casing.

Because the cross-sectional shape of the cable 10 is arcuate, the distance between the outer side portion 24B of the cable 10 and its underlying cylindrical supporting surface remains virtually constant. Were the cable straight in cross-section, it would be tangential to an underlying cylindrical surface causing the edges thereof to extend further into the available annular space. Hence, the edges would more likely abut or be obstructed by an opposite interior wall of the well casing.

The capability of the instant cable to follow closely its underlying supporting surface is a particularly important feature when the cable is used to feed electrical current to centrifugal pumps driven directly by electrical motors having electrical terminals to which the cable conductors are connected. For this application, the permissible lateral tolerances between the radially spaced-apart casings of the pump and the well are often minimal because, for efficiency reasons, it is preferred that the pump diameter be as large as possible. Thus, the cable 10 gives the user the advantage of being able to utilize a larger, more efficient submersible pump.

While various advantageous embodiments have been chosen to illustrate the invention, it will be understood by those skilled in the art that various changes and modifications can be made therein without departing from the scope of the invention as defined in the appended claims.

What is claimed is:

1. An electrical cable structure comprising:

a plurality of elongated, insulated conductors having substantially parallel longitudinal axes, the insulated conductors being spaced laterally from one another;

a jacket of rigid, transverse cross-section covering said conductors, said jacket being elongated in transverse cross-section and comprised of opposite edge portions and opposite side portions, said side portions of said jacket having a preformed, arcuate shape in transverse cross-section, the rigidity of said jacket maintaining the structure arcuate in its transverse cross-section.

2. The cable structure according to claim 1, wherein the centers of said conductors are contained in an arcuate plane, and further wherein said side portions of said jacket between said conductors are in planes substantially parallel to said arcuate plane.

3. The cable structure according to claim 2, wherein a layer of electrical insulation covers each one of said conductors, the layers being spaced from one another in a direction parallel to said arcuate plane.

4. The cable structure according to claim 3, wherein said jacket is formed by metal convolutions.

5. The cable structure according to claim 4 and further including, at least one elongated, force-resisting member within said jacket and between and parallel the spaced-apart insulated conductors;

said member extending across the interior of said jacket substantially from one side thereof to the other.

6. A cable according to claim 5, wherein said at least one force-resisting member is made of a rigid material.

7. A cable according to claim 6 wherein said at least one force-resisting member is made of metal.

8. A cable according to claim 5, wherein said conductors are in side-by-side relationship with the central axes thereof lying in the arcuate plane, thereby forming a cable having two arcuate substantially parallel opposite sides.

9. A cable according to claim 5 wherein said at least one force-resisting member is a substantially continuous, elongated body having substantially flat upper and lower surfaces adjacent said opposite sides of said jacket.

10. A cable according to claim 9 wherein said member includes a plurality of longitudinally spaced slots extending inwardly alternately from said upper and lower surfaces and terminating close to the arcuate plane containing the central axes of said conductors.

11. An elongated sheath for protecting an insulated electrical conductor within said sheath, said sheath having a longitudinal axis and a flattened, transverse cross-sectional shape whereby its width is greater than its thickness, said sheath being formed of a material rigid in transverse cross-section and having sufficient flexibility for long-radius bending along said longitudinal axis, at least a portion of the sheath transverse cross-section preformed with a predetermined fixed curvature which conforms substantially to the curvature of a surface of arcuate cross-section upon which the sheath may be mounted.

12. A sheath according to claim 11 comprised of an overlapped winding of metal tape.

13. In combination, an electrical cable and an elongated structure having an arcuate surface portion upon which the cable is mounted, said cable being elongated and having a longitudinal axis and a flattened transverse cross-sectional shape, said cable being rigid in transverse cross-section and flexible for long radius bending along the longitudinal axis thereof, at least a portion of said cable cross-section preformed with a rigid curvature which conforms substantially to the curvature of said surface portion of said structure at least over the length of said surface portion of said structure opposite the cable.

14. The combination as claimed in claim 13 wherein the longitudinal axis of the cable is substantially parallel to the longitudinal axis of said surface portion.

15. The combination according to claim 14 wherein the structure comprises a cylindrical surface portion.

16. The combination according to claim 14 wherein the cable includes an outer armored sheath of said curvature.

17. The combination according to claim 16 wherein said sheath is comprised of an overlapped winding of thin metal tape.

* * * * *

UNITED STATES PATENT AND TRADEMARK OFFICE

CERTIFICATE OF CORRECTION

PATENT NO. : 4,454,378

DATED : June 12, 1984

INVENTOR(S) : David H. Neuroth

Figure 2:
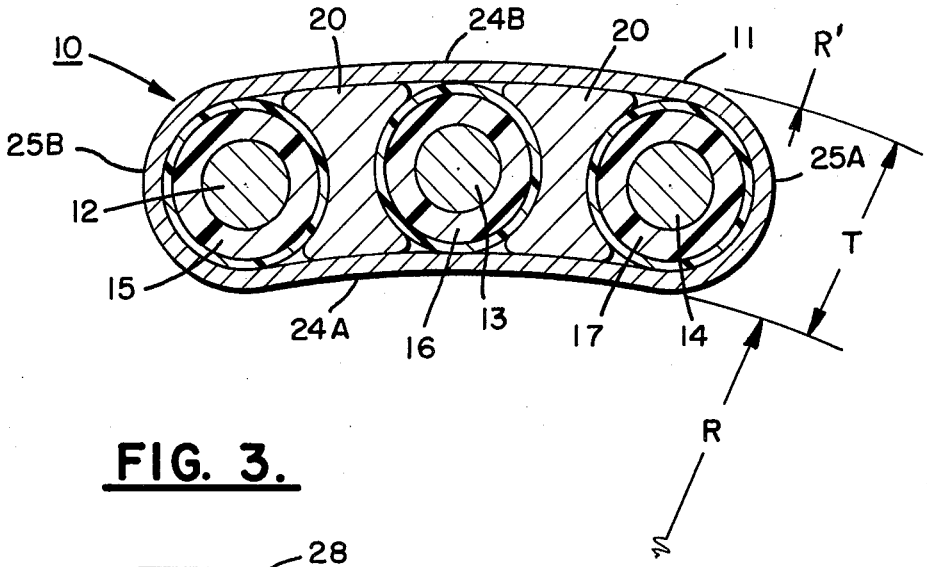
FIG. 2 is an end sectional view of the cable taken along section line 2—2 of FIG. 1 with the underlying structure shown in FIG. 1 removed.
Figure 3:
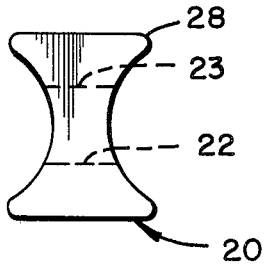
FIG. 3 is an end view of an improved force-resisting member for protecting the insulation on the individual conductors of the cable.

It is certified that error appears in the above-identified patent and that said Letters Patent is hereby corrected as shown below:

The title page and Figures 1, 2 and 3, should appear as shown on the attached sheets.

Signed and Sealed this

*Twenty-sixth* Day of *March 1985*

[SEAL]

*Attest:*

DONALD J. QUIGG

*Attesting Officer*

*Acting Commissioner of Patents and Trademarks*

United States Patent [19]

Neuroth

[11] 4,454,378

[45] * Jun. 12, 1984

[54] ARCUATE ARMORED CABLE

[75] Inventor: David H. Neuroth, Bethany, Conn.

[73] Assignee: Harvey Hubbell Incorporated, Orange, Conn.

[ * ] Notice: The portion of the term of this patent subsequent to Oct. 11, 2000 has been disclaimed.

[21] Appl. No.: 447,969

[22] Filed: Dec. 8, 1982

[51] Int. Cl.[3] ..... H01B 7/18

[52] U.S. Cl. ..... 174/103; 174/102 SP; 174/106 R; 174/109; 174/117 F

[58] Field of Search ..... 174/15 C, 102 SP, 103, 174/106 R, 108, 109, 117 F, 47

[56] References Cited

U.S. PATENT DOCUMENTS

| | | | |
|---|---|---|---|
| 1,740,076 | 12/1929 | Delon | 174/116 X |
| 2,165,738 | 7/1939 | Van Hoffen | 174/105 R |
| 2,391,037 | 12/1945 | Shafer, Jr. | 174/102 SP |
| 2,483,301 | 9/1949 | Roberds | 174/15 C |
| 2,544,233 | 3/1951 | Kennedy | 174/117 R X |
| 2,897,253 | 7/1959 | Davey et al. | 174/109 X |
| 3,351,706 | 11/1967 | Gnerre et al. | 174/105 R |
| 4,196,307 | 4/1980 | Moore et al. | 174/47 |
| 4,262,703 | 4/1981 | Moore et al. | 174/47 X |
| 4,277,642 | 7/1981 | Piper et al. | 174/117 R X |
| 4,282,398 | 8/1981 | Solomon | 174/106 R |
| 4,374,530 | 2/1983 | Walling | 174/47 X |

FOREIGN PATENT DOCUMENTS

| | | | |
|---|---|---|---|
| 1020074 | 11/1957 | Fed. Rep. of Germany | 174/117 R |
| 437525 | 10/1935 | United Kingdom . | |
| 1242494 | 8/1971 | United Kingdom . | |
| 1250823 | 10/1971 | United Kingdom | 174/136 |
| 2069746 | 8/1981 | United Kingdom . | |

*Primary Examiner*—J. V. Truhe
*Assistant Examiner*—Morris H. Nimmo
*Attorney, Agent, or Firm*—Jerry M. Presson; Alfred N. Goodman

[57] ABSTRACT

An armored cable is formed with an arcuate cross-sectional shape which substantially conforms to the curvature of the surface on which it is mounted. This shape takes maximum advantage of the annular space available, for example, between the inner wall defining the circular bore of an oil well and the cylindrical surface of a centrifugal submersible pump on which the cable is mounted. As a result, the diameter, and hence the efficiency, of the pump may be maximized.

17 Claims, 3 Drawing Figures

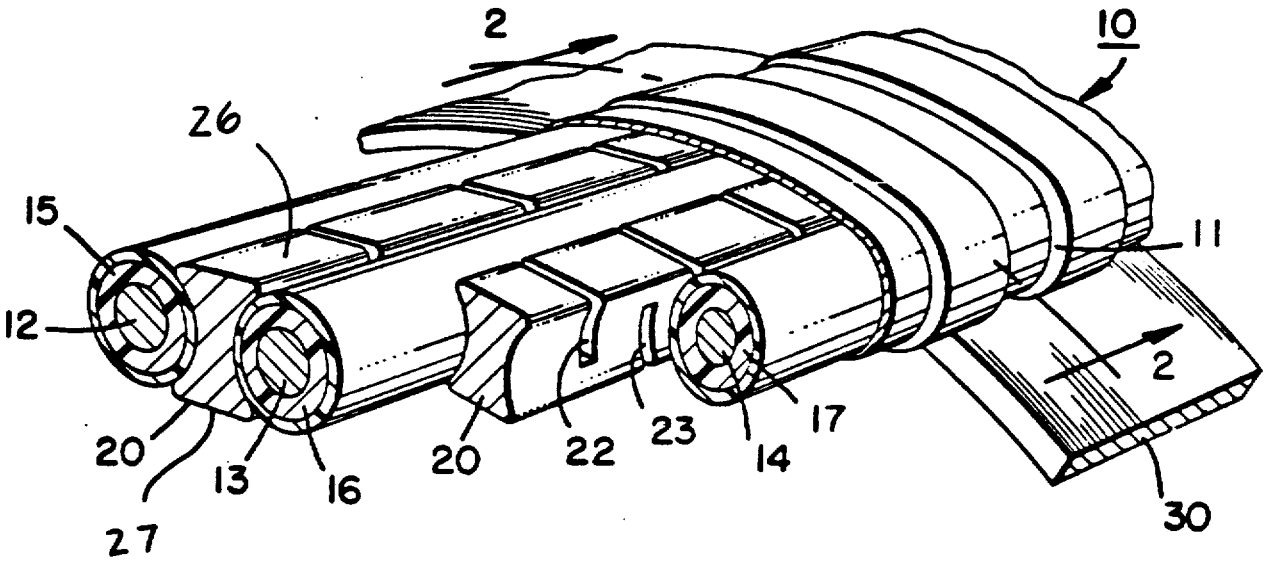

UNITED STATES PATENT AND TRADEMARK OFFICE

CERTIFICATE OF CORRECTION

PATENT NO. : 4,454,378

DATED : June 12, 1984

INVENTOR(S) : David H. Neuroth

It is certified that error appears in the above—identified patent and that said Letters Patent is hereby corrected as shown below:

In Figs. 1, 2 and 3, reference numerals 26 and 27 are added as shown below:

FIG. 1.

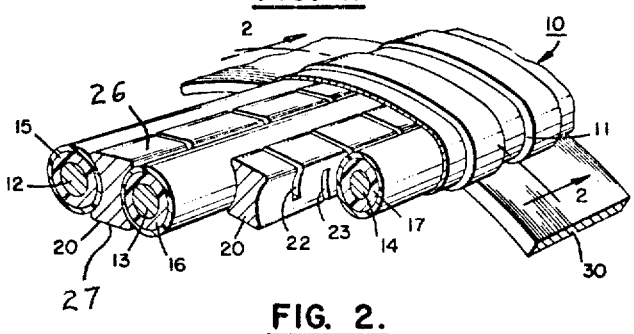

FIG. 2.

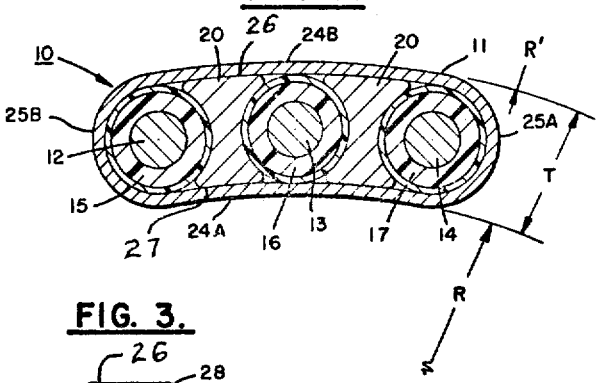

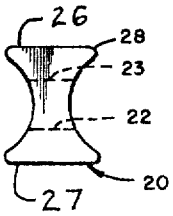

FIG. 3.